US009469384B2

(12) United States Patent
Schellstede

(10) Patent No.: US 9,469,384 B2
(45) Date of Patent: Oct. 18, 2016

(54) VARIABLE STABLE DRILLING BARGE FOR SHALLOW WATER SERVICE (INLAND AND OFFSHORE)

(71) Applicant: Herman Joseph Schellstede, New Iberia, LA (US)

(72) Inventor: Herman Joseph Schellstede, New Iberia, LA (US)

( * ) Notice: Subject to any disclaimer, the term of this patent is extended or adjusted under 35 U.S.C. 154(b) by 60 days.

(21) Appl. No.: 13/961,664

(22) Filed: Aug. 7, 2013

(65) Prior Publication Data

US 2014/0041567 A1 Feb. 13, 2014

Related U.S. Application Data

(60) Provisional application No. 61/742,300, filed on Aug. 7, 2012.

(51) Int. Cl.

| | |
|---|---|
| ***B63B 3/00*** | (2006.01) |
| ***B63B 1/00*** | (2006.01) |
| ***B63B 35/28*** | (2006.01) |
| ***B63B 35/44*** | (2006.01) |
| ***B63B 39/02*** | (2006.01) |
| ***B63B 17/00*** | (2006.01) |
| ***B63B 43/14*** | (2006.01) |
| ***E02F 3/88*** | (2006.01) |
| ***E02F 9/06*** | (2006.01) |

(52) U.S. Cl.

CPC ..... *B63B 35/4413* (2013.01); *B63B 3/00* (2013.01); *B63B 17/00* (2013.01); *B63B 35/28* (2013.01); *B63B 35/44* (2013.01); *B63B 39/02* (2013.01); *B63B 43/14* (2013.01); *E02F 3/8808* (2013.01); *E02F 9/062* (2013.01)

(58) Field of Classification Search

CPC ..... B63B 39/02; B63B 3/00; B63B 17/00; B63B 35/44; B63B 35/4413; B63B 35/28; B63B 43/14; E02F 3/8808; E02F 9/062; E02B 17/00; E02B 17/02

USPC ..... 114/61.29

See application file for complete search history.

(56) References Cited

U.S. PATENT DOCUMENTS

| | | | | |
|---|---|---|---|---|
| 2,691,272 | A * | 10/1954 | Townsend et al. | 175/8 |
| 2,921,442 | A * | 1/1960 | Laborde | E02B 17/027 114/125 |
| 3,011,317 | A * | 12/1961 | Wolff | E02B 17/027 405/207 |
| 3,099,912 | A * | 8/1963 | Wolff | E02B 17/027 114/123 |
| 3,271,964 | A * | 9/1966 | Wolff | E02B 17/027 114/265 |
| 3,433,024 | A * | 3/1969 | Diamond et al. | 405/196 |
| 4,361,104 | A * | 11/1982 | Lloyd et al. | 114/258 |
| 6,203,247 | B1 * | 3/2001 | Schellstede et al. | 405/196 |

* cited by examiner

*Primary Examiner* — Anthony Wiest

(57) ABSTRACT

The invention described herein teaches that one drilling barge can be employed in two different areas. The standard drilling practice requires two vessels to perform the same work as one drilling barge invention. Standard drilling rigs require that one unit will drill well locations in water depths of 8'-18'. A second drilling unit must be provided to drill in water depths of 18'-60'. As a result of this invention, water depths of 8'-60' can be provided by use of the one vessel employing the novel stabilization system. The service area's coverage is increased greatly by use of the invention thereby creating excellent cost reduction and improved drilling procedures in remote and harsh drilling areas. The invention's cost is slightly more than the standard drilling barge however; coverage of the service area can be 500% greater than the standard vessel's coverage.

1 Claim, 15 Drawing Sheets

VARIABLE STABLE DRILLING BARGE FOR SHALLOW WATER SERVICE (INLAND AND OFFSHORE)

CROSS REFERENCE TO RELATED APPLICATIONS

The application is a non-provisional, and claims priority benefit, of U.S. Provisional Patent Application No. 61/742,300 filed on Aug. 7, 2012 which is incorporated herein by specific reference.

STATEMENT REGARDING FEDERALLY SPONSORED RESEARCH OR DEVELOPMENT.

Not applicable.

NAMES OF PARTIES TO A JOINT RESEARCH AGREEMENT

Not applicable.

REFERENCE TO APPENDIX

Not applicable.

BACKGROUND OF THE INVENTION

1. Field of the Invention

The invention disclosed and taught herein relates to the drilling of oil and gas wells located in shallow water such as rivers, bays and sounds and also has the stability to be transported and operated in an ocean environment to a depth of 60'-0" to 100'-0".

2. Description of the Related Art

U.S. Provisional Patent Application No. 61/742,300 filed on Aug. 7, 2012 discloses a drilling vessel with special specifications, which allows the drilling barge to enter narrow/shallow areas to perform service work. The drilling vessel is resting on bottom during drilling operations. By adjusting the vessel stabilizers, the drilling barge performs drilling services in deep offshore waters and can be towed in the open ocean conditions.

U.S. Pat. No. 6,203,247 discloses the detail of methods employed in the drilling barge station-keeping anchors and powered spuds.

The invention disclosed and taught herein allows one drilling vessel to service several work areas such as water depths, ocean conditions and other environmental conditions.

BRIEF SUMMARY OF THE INVENTION

The variable stable drilling barge has been invented to allow one vessel to service several areas. Drilling barges are "stand alone" units used to perform drilling operations in marine environments such as rivers, bays and sounds. These barges are known as "swamp barges". The drilling barge is operated with the hull ballasted down so that the hull rests on bottom. The average operating water depth is 8'-0" to 18'-0" in the inland marine areas. Throughout the world near-shore oil and gas properties are present. At this time, expensive jack-up type rigs are employed.

The invention allows one drilling vessel to enter the inland waters which are shallow (8'-0" to 20'-0") and the entrances are narrow and by employing adjustable stabilizers allows the same vessel to enter the shallow offshore waters to operating depths of 60'-0" to 100'-0"

The vessel has many other qualities to allow the vessel to operate in the vast service area. In order to lower the center of gravity of the vessel, heavy drilling and well service equipment is placed in the lower hull. The relocation of the engines, pumps and support equipment allows the vessel to be stable during service work being conducted in the rivers, bays and sounds. In operations in the rivers, bays and sounds, the stabilizers are in a stowed mode.

The deployment of the stabilizer tanks is conducted employing the river tugs. The stabilizer tanks are saved inboard. The locking pins are removed allowing the stabilizers to be moved outward using the tugboats. Once the tanks are in the deployed mode, they are locked in place via pins.

The invention operates in a near-shore mode. Ocean action is present in the form of breaking waves and ground swells. The drilling operation calls for the vessel to remain on location at all times. The invention has two methods to maintain station while drilling operations are conducted.

Each stabilizing tank is equipped with powered spuds, which are operated from the main vessel unit. Hydraulic motors and a gear rack design allow the spuds to be deployed or retracted by command. The powered spuds are designed to provide penetration from 5'-0" to 30'-0".

In support of the powered spuds, a four-point anchoring system is employed. Two anchors are set, port and starboard. Two additional anchors are set directly ahead of the vessel bow. The anchor winches are located at the lower hull, from which the cables are directed upward to the upper hull. The cables are then redirected to the deck level. The cables are connected to suitable anchors. The anchors are deployed via the support tugs.

The mooring of the vessel is provided by both a powered spud and an anchoring system. The bow anchors are set a suitable distance from the drilling barge. In case of a well blowout, the vessel can be winched from the well center via the bow anchor/anchor winch system. The vessel's captain can command that the vessel be de-ballasted and the winches engaged. As the vessel is de-ballasted, the winches retract the vessel from the well center allowing the well to be accessed by firefighting crews.

The upper structure of the vessel is constructed of lightweight composite materials. All non-loaded structural members will be constructed of composite materials and fastened to the steel support members. The weight reduction is sustained and again allows a lower center of gravity for the unit.

The composite materials have an excellent resistance to weathering, rusting or chalking. Hence, an extended useful life is possible with a low maintenance cost.

The living accommodations are also constructed of molded composite materials. The internal structures of the quarters are also constructed of composites including doors, galleys, tables, benches, etc. This design method will also lower the weight located on the upper deck.

The heliport is located at an extreme height. The weight of the heliport is reduced by use of an aluminum construction and trapezoidal structure design. Marine-grade materials will be employed. The heliport extends outward from the bow and is supported via plate girders. The box girders also serve as intake ducting for the vessel's ventilation system.

Drilling of gas wells is different from oil wells. During a gas well blowout, gas can surround the rig with explosive gas. The drilling rig's ventilation system can be subjected to surrounding gas. The invention has a special ventilation system, which allows the ventilated air to be taken from the farthest point from the well center allowing the safest method for providing ventilated air.

Once the invention is placed on bottom and is moored by powered spuds and anchors, movement of the barges should not be conducted in drilling of serviced wells. The drilling mast and substructure are mounted onto a rail system. This system allows the drilling of clustered wells without moving the drilling vessel.

The mast that is employed with the invention provides a height that allows four joints of pipe to be drilled in one event (quad). This system allows a more efficient drilling program. The mast is supported by an automatic drill pipe handling system. The drilling operations are conducted without the use of human effort. All systems are robotic.

Due to the design of the vessel, boarding of the vessel is only conducted by use of the personnel lift system. Non-authorized persons cannot board the vessel, which assures a safe working area for the employees and owners.

The invention provides many systems and devices that enable the vessel to be very economical with relation to the extended service area provided.

DETAILED DESCRIPTION OF THE INVENTION

Figure 1:
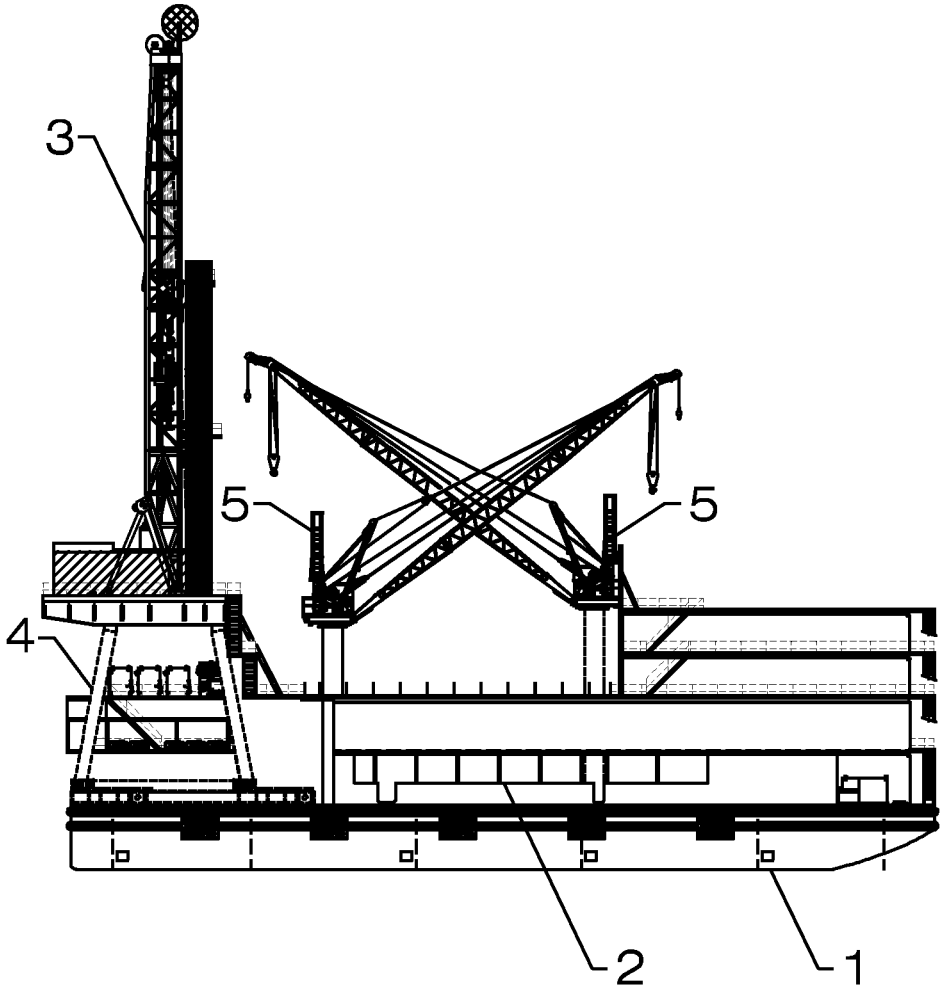
FIG. 1 illustrates a standard drilling barge unit. (Profile view.)

FIG. 1 illustrates a general profile view of a standard swamp-drilling barge. A hull unit 1 that supports the drilling rig is illustrated. The machinery deck 2 is illustrated. The mast 3 and hoisting equipment is illustrated. The substructure 4 and solids control systems are illustrated. The vessel's cranes 5 are each located on port and starboard sides. The drilling barge as illustrated in FIG. 1 is typical and is a "stand alone" system.

Figure 2:
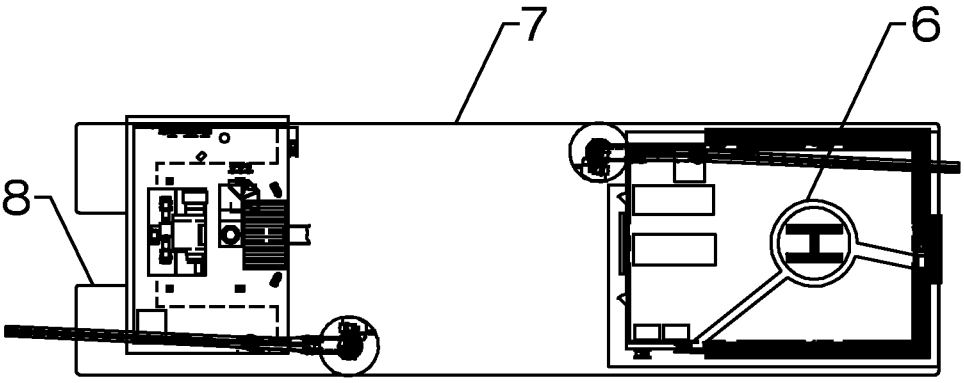
FIG. 2 illustrates a standard drilling barge unit. (Plan view.)

FIG. 2 illustrates a plan view of a typical standard drilling rig. The heliport 6 is used for personnel and equipment transportation. A pipe rack area 7 is used to stow tubular goods for the drilling process. A keyway 8 is provided in which the wells are drilled.

Figure 3:
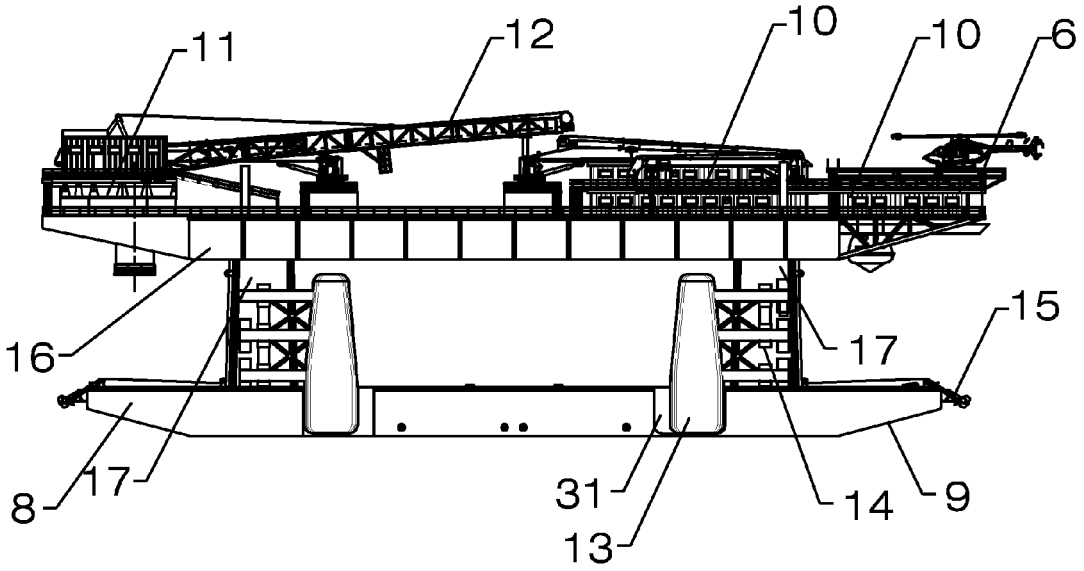
FIG. 3 illustrates the invention viewed in a profile elevation.

FIG. 3 illustrates the profile view of the invention vessel. A special lower support hull 9 is designed with a keyway 8 and also storage voids 31 in which the stabilizers 13 are stored when the vessel is operating inland. The stabilizers 13 are supported by a support swing arm 14. The support swing arm 14 allows the stabilizers 13 to be stored or deployed. The stabilizer 13, when deployed, provides additional support to increase the stability of the vessel.

The upper deck 16 is supported by the vessel's vertical extension structure 17. The movable substructure 11 is illustrated where several wells can be drilled without moving the vessel. An extended mast unit 12 is approximately 45' greater in length than standard masts. FIG. 3 illustrates the area designated for workers' accommodations 10. The heliport 6 is illustrated. The invention shown in FIG. 3 can operate in a minimum water depth of 8'-0". The invention can be serviced with stabilizers deployed in a water depth of 60'-0" to 100'-0".

Figure 4:
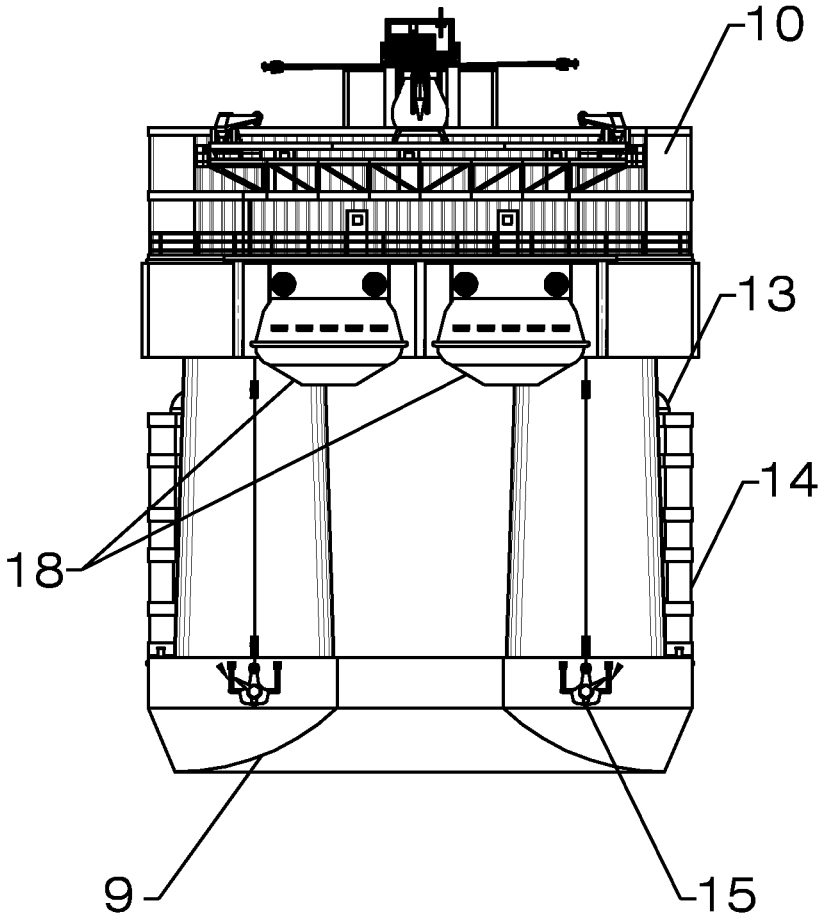
FIG. 4 illustrates the invention in an end profile view with the stabilizer stowed.

FIG. 4 illustrates the invention with the stabilizers 13 in stowed mode. The vessel, illustrated in the transportation mode FIG. 4, can enter narrow passages such as rivers. The bow view is also illustrated in FIG. 4. Lifeboats 18 are located at the level of the accommodations 10. The vessel's anchor mooring system 15 is illustrated in FIG. 4.

Figure 5:
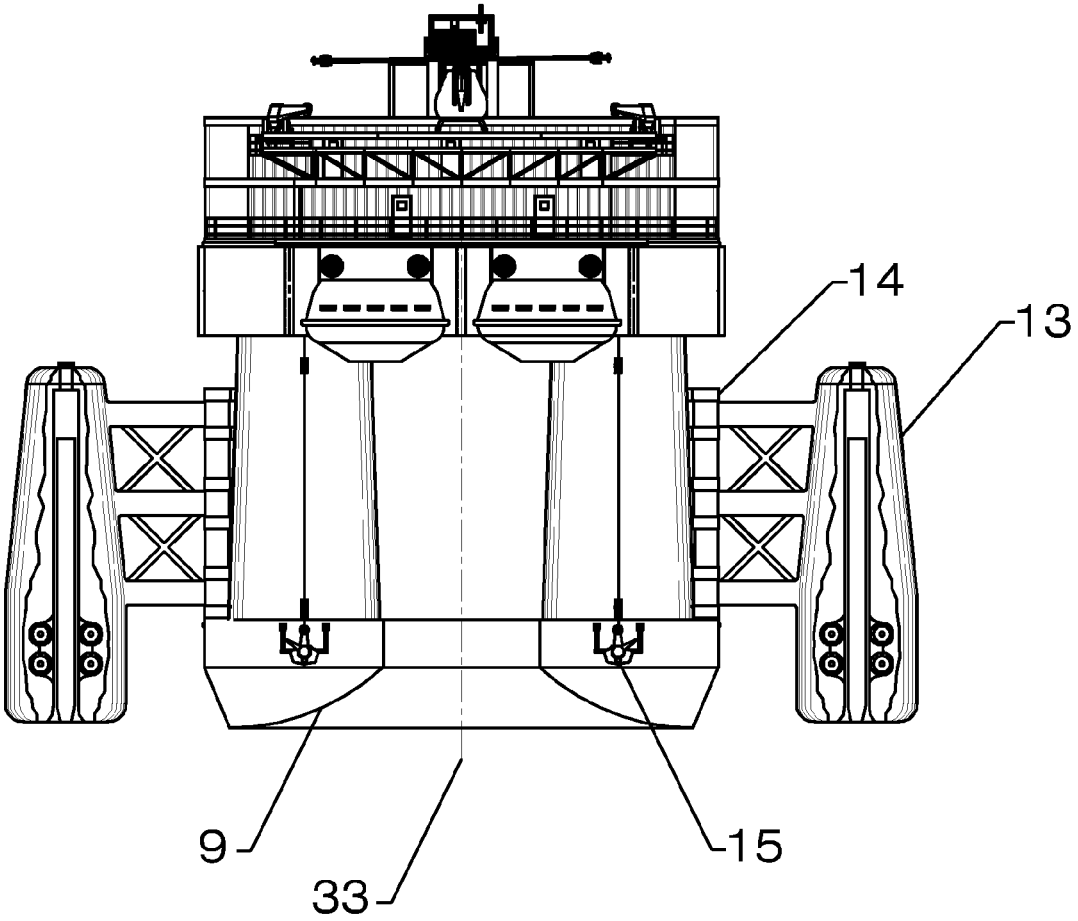
FIG. 5 illustrates the invention in an end profile view with the stabilizer deployed.

FIG. 5 illustrates the invention with the stabilizers 13 deployed. The stabilizer 13 extends by way of the support swing arm 14 allowing the center of the stabilizers 13 to be a substantial distance from the centerline 33 of the vessel. This provides additional stabilization.

A typical anchor unit is employed in the anchor mooring system 15. The anchor units are fitted on the bow (port and starboard sides) and on the stern (port and starboard sides) of the vessel.

Figure 6:
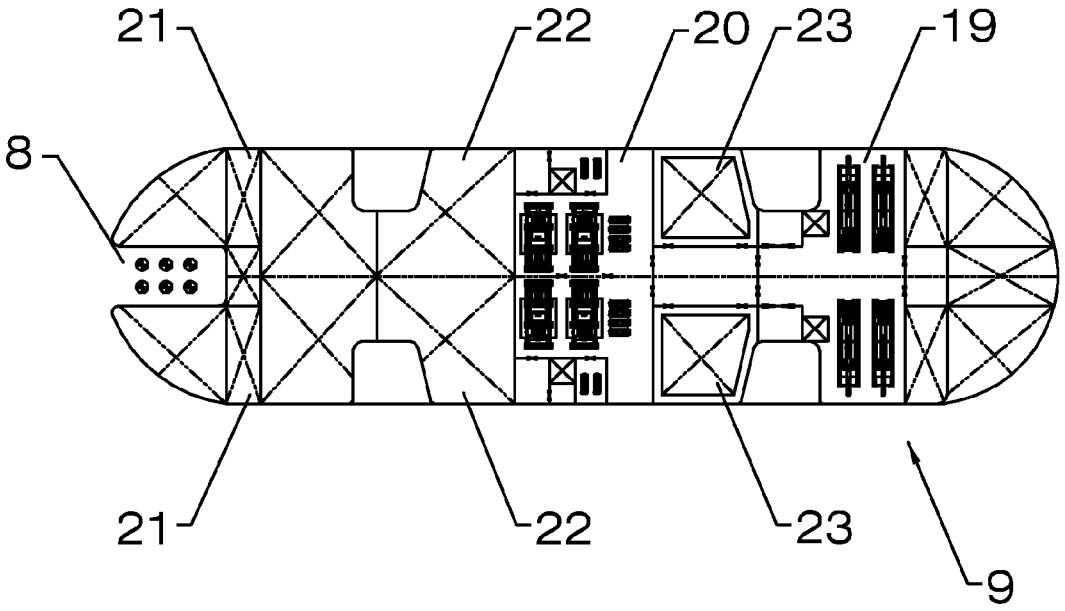
FIG. 6 illustrates the lower hull showing the equipment location. (Plan view.)

FIG. 6 illustrates a hold plan of the lower support hull 9. The lower support hull 9 accommodates various areas. Pollution tank 21, ballast tanks 22, and fuel tanks 23 are located throughout the lower support hull 9. The pump room 20 is used for drilling and de-ballasting. The keyway 8, and the rig's engine room 19 are also provided in the lower support hull 9. The complete lower support hull 9 is ventilated by the use of blowers located in the upper deck area.

Figure 7:
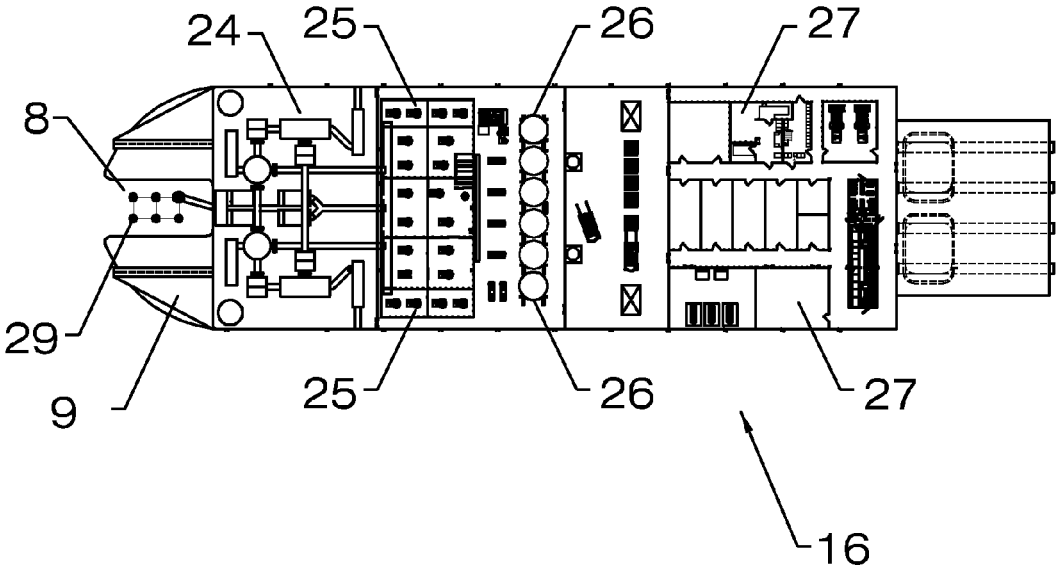
FIG. 7 illustrates the upper deck plan view showing placement of equipment.

FIG. 7 illustrates a plan view of the upper deck 16 level. The well pattern 29 bay area is illustrated at the keyway 8 of the lower support hull 9. The solids control unit 24, drilling fluid tanks 25, dry mud storage areas 26, and various workshops and storage 27 areas are located throughout the upper deck 16.

Figure 8:
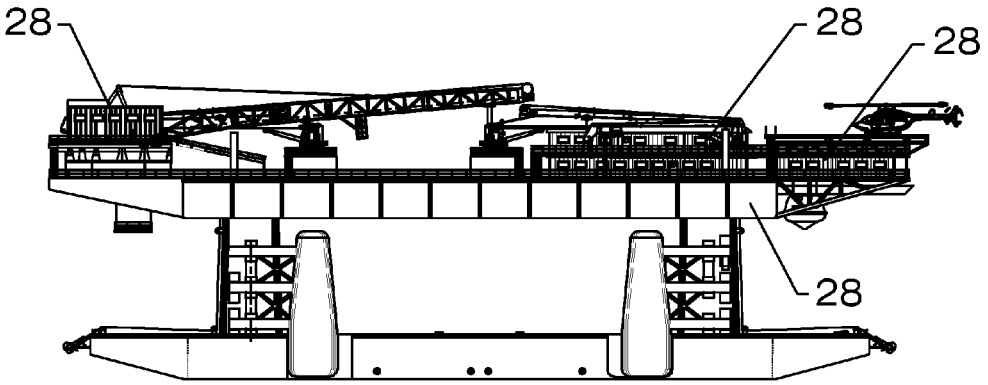
FIG. 8 illustrates the typical use of composite materials employed in non load-bearing walls and structures.

FIG. 8 illustrates non load-carrying walls that are constructed of composite material panels 28. The composite material panels 28 reduce weight and increase the speed of construction. The accommodations 10 are constructed of composite material panels 28. The wind walls about the rig are also constructed of composite material panels 28.

Figure 9:
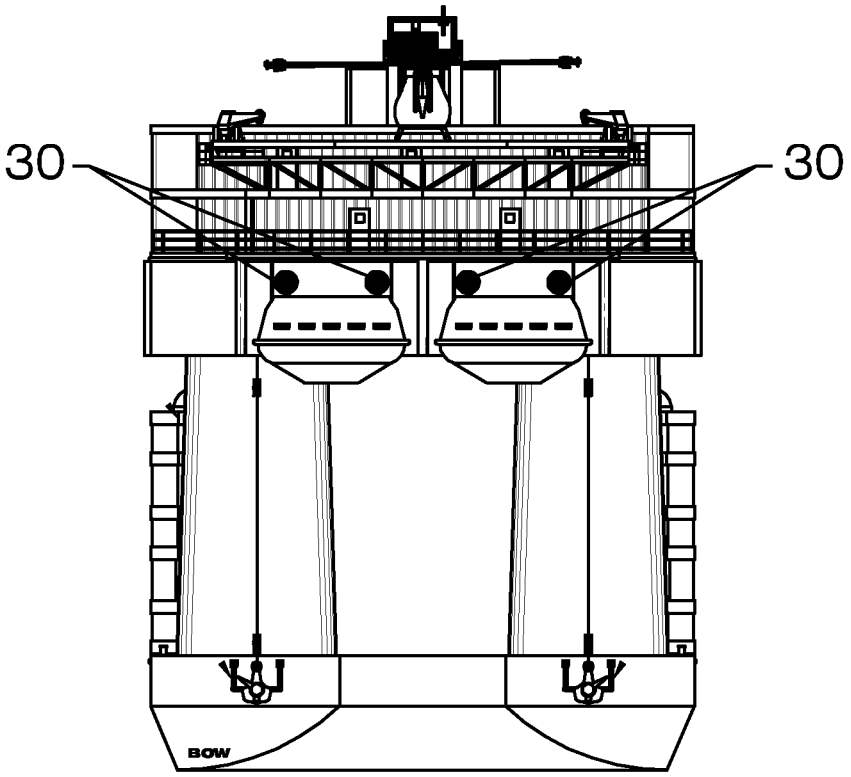
FIG. 9 illustrates the invention's ventilation system.

FIG. 9 illustrates intake air ventilation ducts 30 that extend outward from the heliport 6. The air intake ventilation ducts 30 gathers air from the farthest point of the well's bay area.

Figure 10:
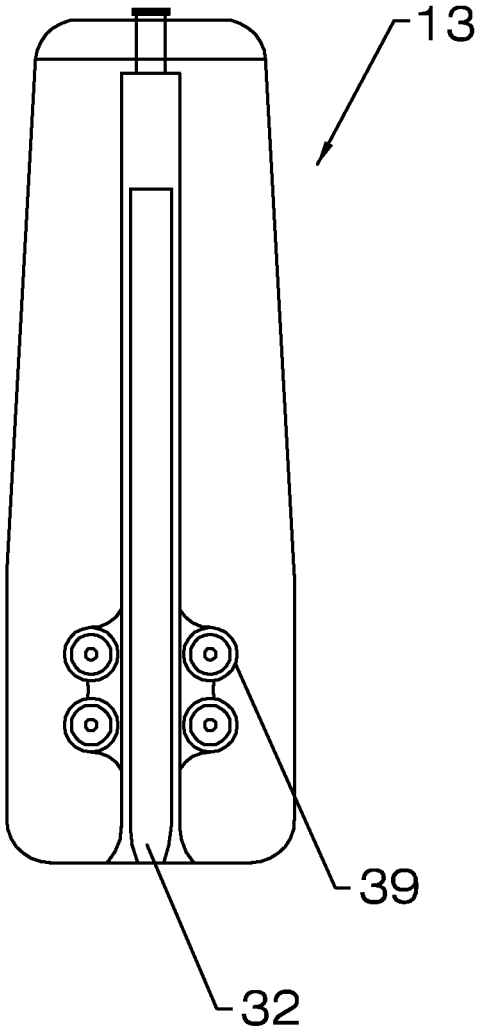
FIG. 10 illustrates the hydraulic powered spud location and method of operation.

FIG. 10 illustrates a typical stabilizer 13 mounted internally on a spud 32 and a hydraulic power system 39 that controls the speed during mooring operations.

Figure 11:
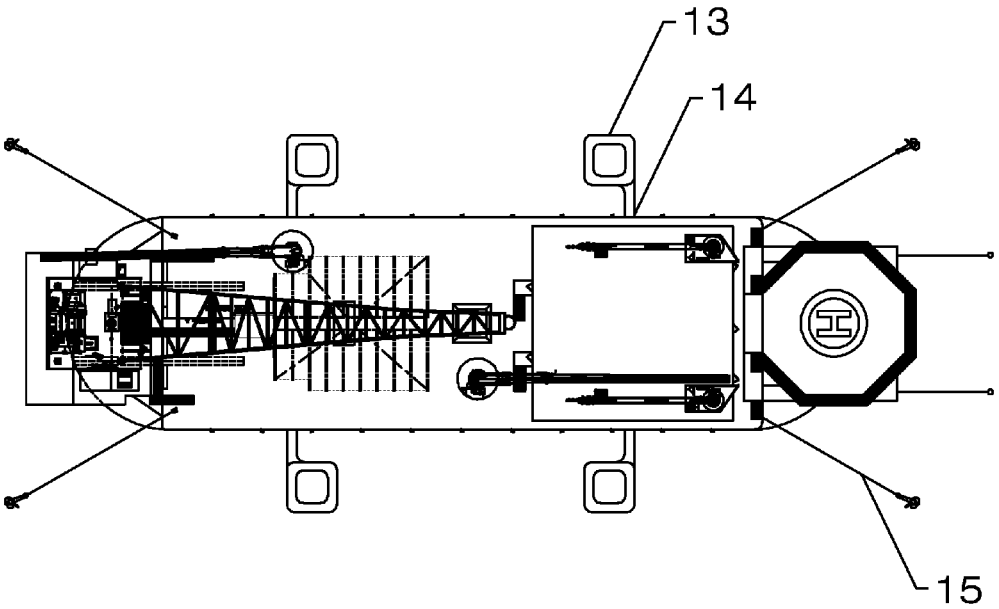
FIG. 11 illustrates the anchoring area for the mooring of the vessel.

FIG. 11 illustrates a plan view of the vessel with stabilizers 13 deployed. The view also illustrates the anchor mooring system 15 in a deployed mode.

Figure 12:
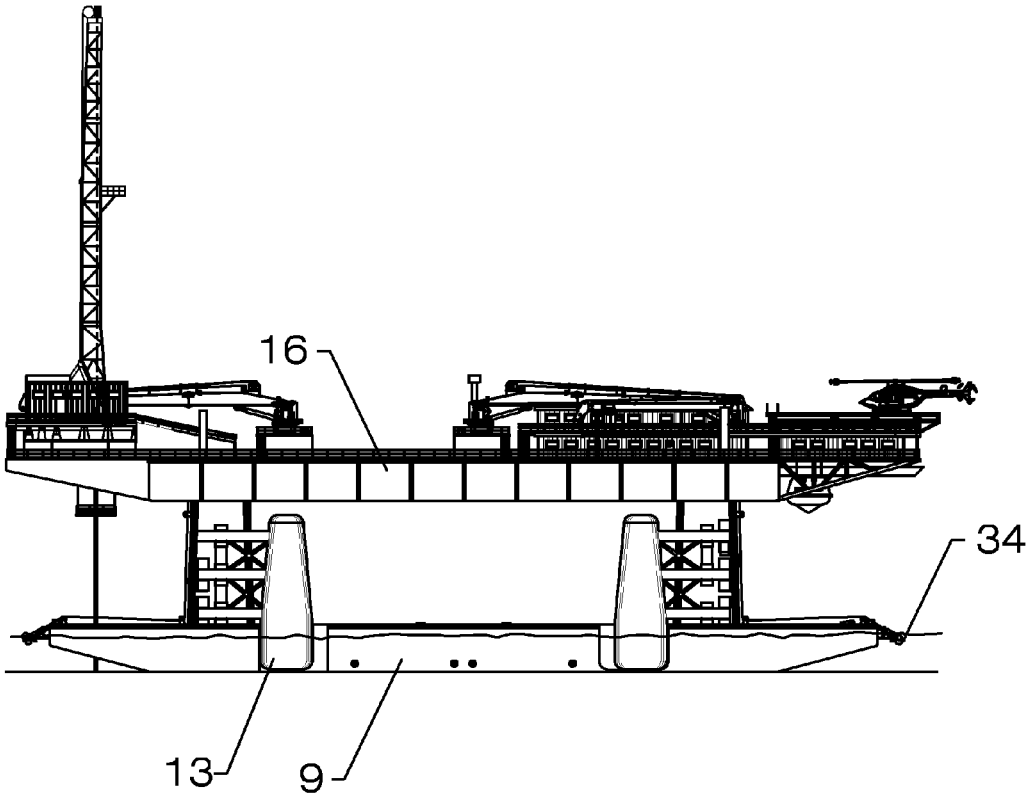
FIG. 12 illustrates the vessel operating in minimum water depth with stabilizer tanks stowed

FIG. 12 illustrates the invention in a minimum water depth 34 of 8'-0".

Figure 13:
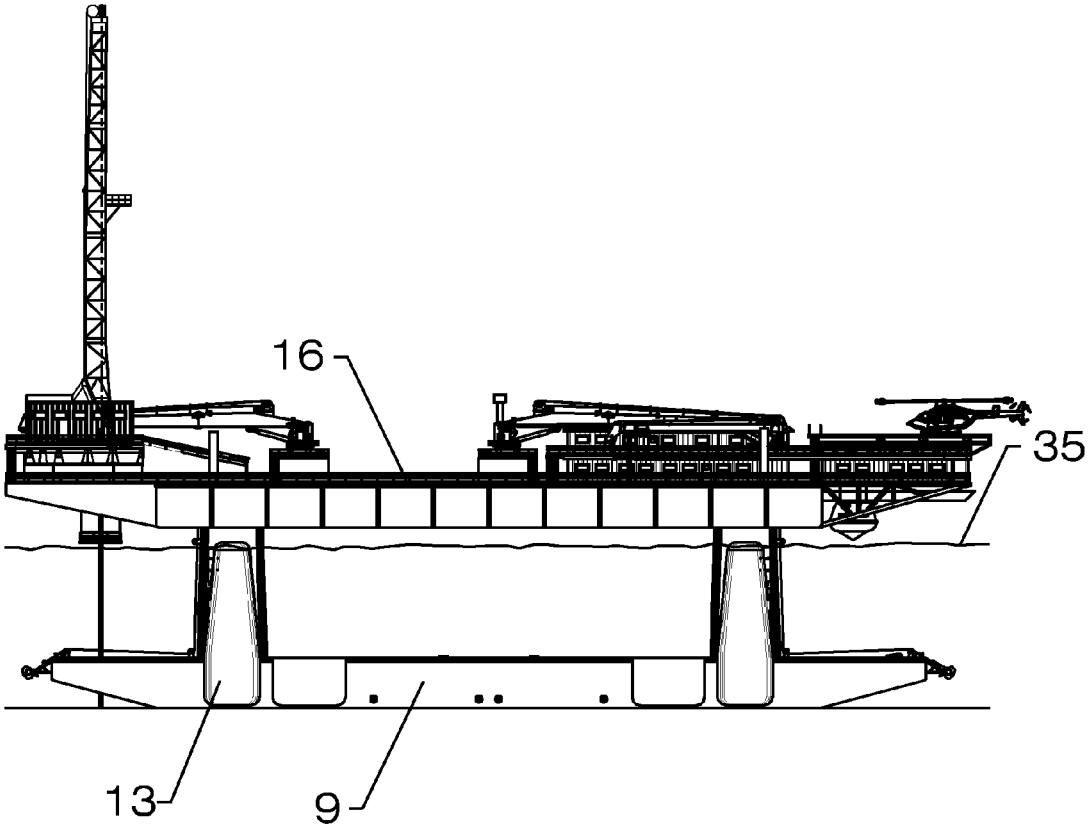
FIG. 13 illustrates the vessel operating in the maximum offshore area showing the stabilizer deployed.

FIG. 13 illustrates the invention in the maximum water depth 35 of approximately 60'-0".

Figure 14:
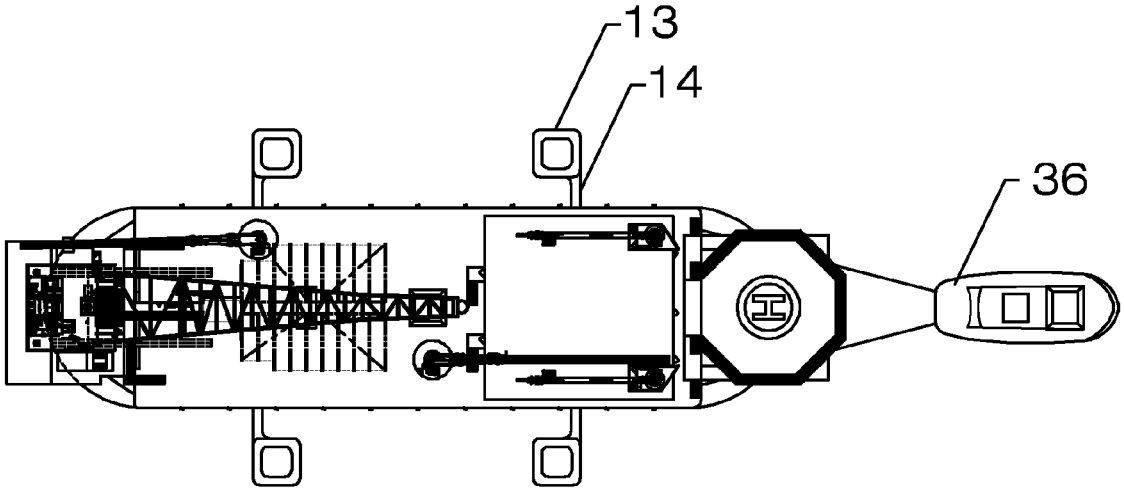
FIG. 14 illustrates the vessel being towed in offshore waters with stabilizer deployed.

FIG. 14 illustrates the invention being towed offshore by a tug unit 36 with the stabilizers 13 deployed for vessel stability.

Figure 15:
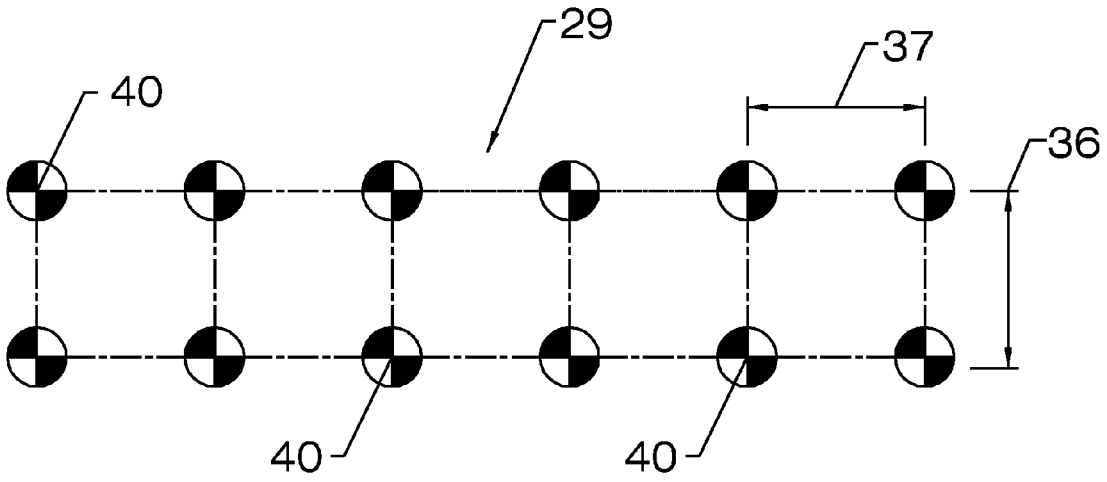
FIG. 15 illustrates the vessel's drilling well pattern of a 12-well cluster.

FIG. 15 illustrates a typical well pattern 29 in which the transverse distance 37 between the well centers 40 is approximately 7'-6". The longitudinal distance 38 between the well centers 40 is 7'-6". Twelve (12) wells can be drilled without moving the vessel. Clustered well drilling is possible by the use of this method.

General Field Operations of the Invention

The invention as illustrated in FIG. 3 has a stabilizer system that allows the vessel to enter narrow inland rivers, bays and sounds. The stabilization system, once deployed, can operate in offshore waters to a depth of 60'-0" to 100'-0"

This system allows the vessel's service area to be increased exponentially. The drilling barge has the stabilizers stored (FIG. 4) which results in a narrow footprint of the vessel. As the vessel is towed to the work location, shallow areas can be reached due to the use of lightweight construction materials allowing a lightship draft.

In remote areas, inland areas are reached via dredging which is very expensive. Hence, this invention has been designed to operate in water depths of 8'-0". Most standard drilling barges have a minimum water depth of 9'-6" to 10'-0". The vessel has been designed to be equipped with rounded ends (bow and stern) which allow travel in narrow passages. The invention can enter any and all locations which can be reached via standard drilling barges.

The vessel captain can adjust the drilling barge for offshore towing and near-shore operations. The captain will deploy the four stabilizer tanks and lock the units in place. The deployment project is conducted in sheltered waters. Once the stabilizers are deployed, a trimming process is conducted for towing purposed. The offshore tug is engaged and the vessel can be towed in coastal areas. The continental shelves of the world have vast expansion of shallow water extending many miles from the shoreline. Hence, water depths between 60'-0" and 100'-0" can be located over 20 miles from the shoreline.

Once the vessel is "on location", the vessel is ballasted down whereas the lower hull rest on sea bottom. The hydraulic powered spuds are engaged and locked in place. The offshore tug will deploy an array of anchors. The anchors are set into place. The invention is prepared for drilling operations. Between 2 and 12 wells can be drilled from one location without moving the vessel.

In general, the rig has the ability to secure inland marine areas and shallow water, near shore ocean waters.

What is claimed is:

1. A floating marine drilling barge comprising:

a watertight lower hull with a bow, a stern, a port side, and a starboard side, said watertight lower hull comprising at least one storage void inset from each of the port side and the starboard side and at least one keyway located on the bow or stern end of the watertight lower hull;

an upper equipment deck, supported above the watertight lower hull by a vertical extension structure;

a moveable sub structure including a mast arranged on the upper equipment deck vertically aligned with the keyway on the watertight lower hull;

at least one vertically mounted stabilizer pivotably attached to the floating marine drilling barge on each of the port side and starboard side via horizontal support swing arms, said at least one vertically mounted stabilizer configured to move between a stored position in which the stabilizer is located within the storage void on the port and starboard side of the watertight lower hull and the horizontal support swing arms are substantially parallel to the port side and starboard side of the watertight lower hull and a deployed position where said at least one vertically mounted stabilizer is extended away from the lower watertight hull and the horizontal support swing arms are substantially perpendicular to the port side and starboard side of the watertight lower hull; and wherein the at least one vertically mounted stabilizer further comprises a spud which is vertically aligned with the stabilizer and connected to a hydraulic power system for extending said spud from the vertically mounted stabilizer to assist in mooring the barge to the seafloor and for retracting said spud into the stabilizer.

* * * * *